US011296413B2

(12) United States Patent
Tai et al.

(10) Patent No.: US 11,296,413 B2
(45) Date of Patent: Apr. 5, 2022

(54) ANTENNA STRUCTURE

(71) Applicant: WISTRON NEWEB CORPORATION, Hsinchu (TW)

(72) Inventors: Chih-Feng Tai, Hsinchu (TW); Tzu-Chi Lu, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 95 days.

(21) Appl. No.: 17/020,999

(22) Filed: Sep. 15, 2020

(65) Prior Publication Data

US 2021/0313692 A1 Oct. 7, 2021

(30) Foreign Application Priority Data

Apr. 1, 2020 (TW) ..... 109111381

(51) Int. Cl.
*H01Q 5/371* (2015.01)
*H01Q 9/04* (2006.01)

(52) U.S. Cl.
CPC ..... *H01Q 5/371* (2015.01); *H01Q 9/0407* (2013.01)

(58) Field of Classification Search
CPC ..... H01Q 5/30; H01Q 5/307; H01Q 5/321; H01Q 5/371; H01Q 5/378; H01Q 5/385; H01Q 5/392; H01Q 5/50; H01Q 1/241–243; H01Q 9/04; H01Q 9/0407
See application file for complete search history.

(56) References Cited

U.S. PATENT DOCUMENTS 8,779,986 B2 * 7/2014 Fan ..... H01Q 9/42 343/700 MS
9,252,490 B2 2/2016 Wei
10,069,199 B2 9/2018 Chen et al.
2012/0001815 A1 * 1/2012 Wong ..... H01Q 9/0414 343/749
2013/0207861 A1 * 8/2013 Huang ..... H01Q 13/10 343/767

(Continued)

FOREIGN PATENT DOCUMENTS

CN 106299679 B 6/2019
TW 200905987 A 2/2009

(Continued)

*Primary Examiner* — Jason Crawford
(74) *Attorney, Agent, or Firm* — McClure, Qualey & Rodack, LLP

(57) ABSTRACT

An antenna structure is provided. The antenna structure includes a first radiation element, a second radiation element, and a feeding element. The first radiation element includes a first radiation portion, a second radiation portion, and a feeding portion. The second radiation element includes a third radiation portion, a fourth radiation portion, and a grounding portion. The third radiation portion and the first radiation portion are separate from each other and coupled to each other, the third radiation portion and the second radiation portion are separate from each other and coupled to each other, and the fourth radiation portion and the first radiation portion are separate from each other and coupled to each other. The feeding element is electrically connected with the feeding portion and the grounding portion. A junction between the feeding element and the feeding portion is defined as a feeding point.

15 Claims, 9 Drawing Sheets

(56) References Cited

U.S. PATENT DOCUMENTS

| | | | | |
|---|---|---|---|---|
| 2014/0361948 | A1* | 12/2014 | Tanaka | H01Q 1/38 343/861 |
| 2015/0200456 | A1* | 7/2015 | You | H01Q 5/321 343/722 |
| 2015/0236422 | A1* | 8/2015 | You | H01Q 5/378 343/729 |
| 2018/0048076 | A1* | 2/2018 | Wei | H01Q 1/243 |
| 2019/0044232 | A1* | 2/2019 | Tseng | H01Q 5/378 |
| 2020/0021028 | A1* | 1/2020 | Wu | H01Q 21/28 |
| 2021/0013607 | A1* | 1/2021 | Tai | H01Q 9/42 |
| 2021/0313692 | A1* | 10/2021 | Tai | H01Q 5/371 |

FOREIGN PATENT DOCUMENTS

| | | |
|---|---|---|
| TW | I487195 B | 6/2015 |
| TW | I524594 B | 3/2016 |

* cited by examiner

U

ANTENNA STRUCTURE

CROSS-REFERENCE TO RELATED PATENT APPLICATION

This application claims the benefit of priority to Taiwan Patent Application No. 109111381, filed on Apr. 1, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and more particularly to an antenna structure with an operating frequency band that is applicable for the 4th generation mobile networks and the 5th generation mobile networks.

BACKGROUND OF THE DISCLOSURE

With the advancement of the 5th generation mobile networks (5G), the design of a current antenna structure is no longer sufficient for an operating frequency band of the 5th generation mobile networks. Generally, to further support the operating frequency band of 5G; an antenna that supports the operating frequency band of 5G is additionally added to a current product. However, since current products are designed toward miniaturization, there is hardly any space for adding a 5G antenna.

Therefore, how the above-mentioned deficiencies can be overcome through improving the design of an antenna structure has become an important issue in this field.

SUMMARY OF THE DISCLOSURE

In response to the above-referenced technical inadequacies, the present disclosure provides an antenna structure.

In one aspect, the present disclosure provides an antenna structure that includes a first radiation element, a second radiation element, and a feeding element. The first radiation element includes a first radiation portion, a second radiation portion, and a feeding portion that is electrically connected between the first radiation portion and the second radiation portion. The second radiation element includes a third radiation portion, a fourth radiation portion, and a grounding portion that is electrically connected between the third radiation portion and the fourth radiation portion. The third radiation portion and the first radiation portion are separate from each other and coupled to each other, the third radiation portion and the second radiation portion are separate from each other and coupled to each other, and the fourth radiation portion and the first radiation portion are separate from each other and coupled to each other. The feeding element is electrically connected with the feeding portion and the grounding portion, with a junction between the feeding element and the feeding portion being defined as a feeding point. Further, a first predetermined distance is defined in a first direction between an edge of an open end of the first radiation portion and the feeding point, a second predetermined distance is defined in the first direction between an edge of an open end of the third radiation portion and the feeding point, and the first predetermined distance is less than the second predetermined distance.

One of the beneficial effects of the present disclosure is that, by virtue of "a first predetermined distance being defined in a first direction between an edge of an open end of the first radiation portion and the feeding point, a second predetermined distance being defined in the first direction between an edge of an open end of the third radiation portion and the feeding point, and the first predetermined distance being less than the second predetermined distance", the antenna structure of the present disclosure can generate an operating frequency band with a frequency range between 617 MHz and 698 MHz.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
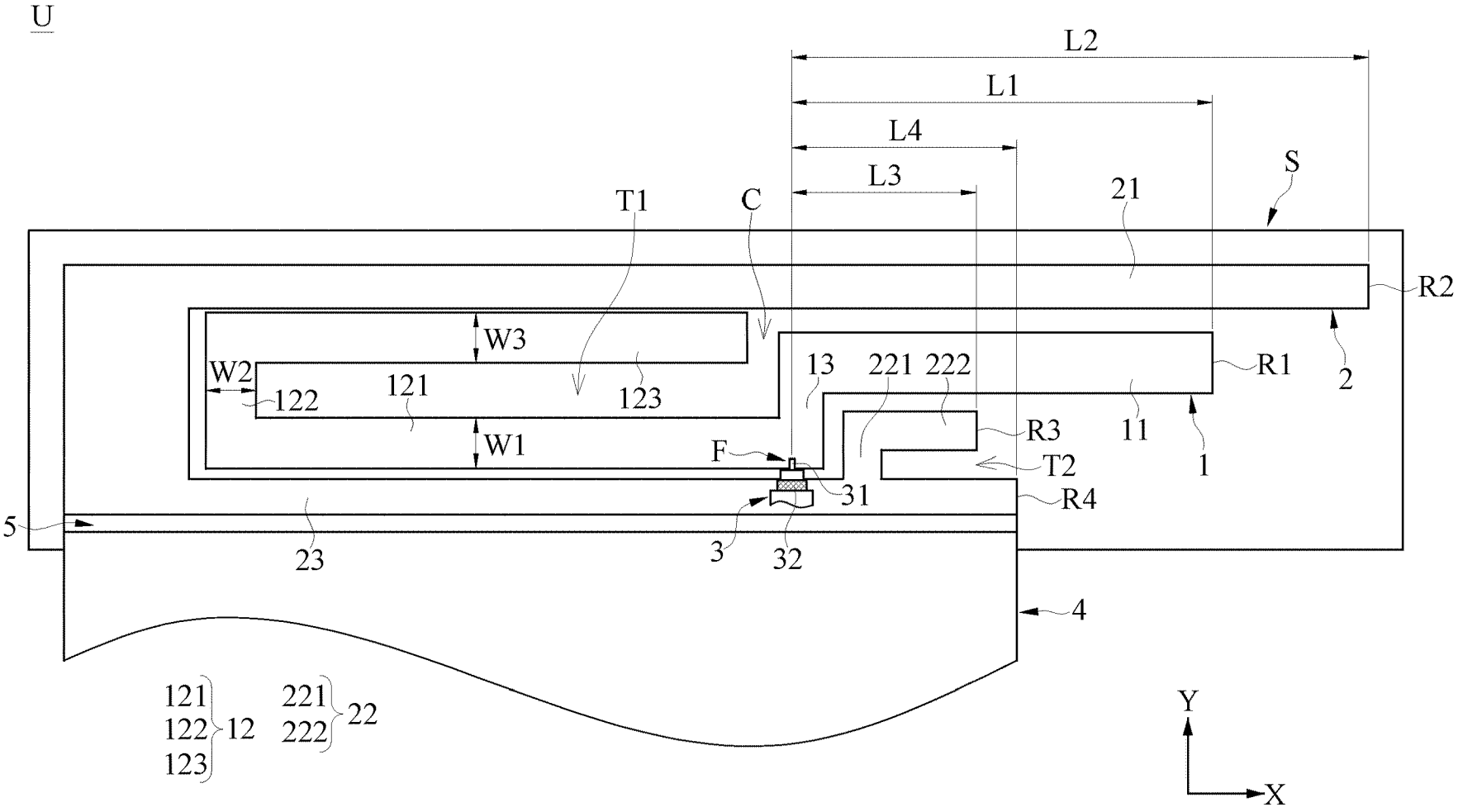
FIG. 1 is a top schematic view of an antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Throughout the entire description of the present disclosure, the word "connect" indicates a physical connection between two elements, and such a connection can be either direct or indirect. In addition, throughout the entire description of the present disclosure, the word "couple" indicates that two elements are separate from each other and not physically connected. It is through an electric field energy generated by an electric current of one element that an electric field energy of another element is activated.

First Embodiment

Reference is made to FIG. 1, in which a top schematic view of an antenna structure according to a first embodiment of the present disclosure is shown. The first embodiment of the present disclosure provides an antenna structure U, which includes a first radiation element 1, a second radiation element 2, and a feeding element 3. Further, the antenna structure U includes a substrate S. The first radiation element 1 and the second radiation element 2 are disposed on the substrate S, and the feeding element 3 is electrically connected between the first radiation element 1 and the second radiation element 2. For example, the first radiation element 1 and the second radiation element 2 can be a metal sheet, a metal lead, or any other electrical conductor that is capable of conducting electricity. The feeding element 3 can be a coaxial cable, and the material of the substrate S can be an epoxy glass fiber substrate (FR-4). However, the present disclosure is not limited thereto. In addition, the feeding element 3 has a feeding end 31 and a grounding end 32. The feeding end 31 is electrically connected with the first radiation element 1, and the grounding end 32 is electrically connected with the second radiation element 2.

Following the above, the antenna structure U further includes a grounding element 4 that is electrically connected with the second radiation element 2. In a preferred embodiment, the antenna structure U can further include a bridging element 5 that is electrically connected between the second radiation element 2 and the grounding element 4. It should be noted that, the purpose of having the bridging element 5 installed is to have the grounding element 4 and the second radiation element 2 be easily connected with each other. Although it is described in the embodiment of FIG. 1 that the bridging element 5 can be further installed, the bridging element 5 can be omitted in other embodiments. It is worth mentioning that, for example, the material of the bridging element 5 can be tin or any other electrically conductive materials, and the material of the grounding element 4 can be copper or any other electrically conductive materials. However, the present disclosure is not limited thereto.

The first radiation element 1 includes a first radiation portion 11, a second radiation portion 12, and a feeding portion 13 that is electrically connected between the first radiation portion 11 and the second radiation portion 12. The second radiation element 2 includes a third radiation portion 21, a fourth radiation portion 22, and a grounding portion 23 that is electrically connected between the third radiation portion 21 and the fourth radiation portion 22. The feeding element 3 is electrically connected with the feeding portion 13 and the grounding portion 23. Further, the feeding end 31 of the feeding element 3 is electrically connected with the feeding portion 13, and the grounding end 32 of the feeding element 3 is electrically connected with the grounding portion 23. In addition, the grounding element 4 is electrically connected with the grounding portion 23 of the second radiation element 2. Preferably, the grounding element 4 and the grounding portion 23 are connected with each other by using the bridging element 5. It should be noted that the first radiation portion 11, the second radiation portion 12 and the feeding portion 13 can be integrally formed, and the third radiation portion 21, the fourth radiation portion 22 and the grounding portion 23 can be integrally formed.

The first radiation portion 11 extends in a first direction (a positive x-direction) relative to the feeding portion 13, and the second radiation portion 12 extends in a second direction (a negative x-direction) relative to the feeding portion 13. That is to say, the first radiation portion 11 is disposed at one side of the feeding portion 13 (for example, but not limited to, a right side), and the second radiation portion 12 is disposed at another side of the feeding portion 13 (for example, but not limited to, a left side). However, the present disclosure is not limited thereto. Moreover, a surrounding area C is formed by the third radiation portion 21, the grounding portion 23, and the fourth radiation portion 22, and the first radiation element 1 is disposed in the surrounding area C formed by the second radiation element 2.

The second radiation portion 12 includes a first radiator 121 that is electrically connected with the feeding portion 13, a second radiator 122 that is electrically connected with the first radiator 121 and is in a turned position with respect to the first radiator 121, and a third radiator 123 that is electrically connected with the second radiator 122 and is in a turned position with respect to the second radiator 122. More specifically, the first radiator 121 of the second radiation portion 12 extends in a second direction (a negative x-direction) relative to the feeding portion 13, the second radiator 122 of the second radiation portion 12 extends in a third direction (a positive y-direction) relative to the first radiator 121, and the third radiator 123 of the second radiation portion 12 extends in the first direction (the positive x-direction) relative to the second radiator 122. In this way, in the present disclosure, a first cavity T1 that is in the shape of the letter "C" is formed by the first radiator 121, the second radiator 122, and the third radiator 123. However, the present disclosure is not limited thereto.

The fourth radiation portion 22 is electrically connected with the grounding portion 23 and extends in the first direction (the positive x-direction) relative to the feeding portion 13. More specifically, the fourth radiation portion 22 includes a first extension segment 221 that is connected with the grounding portion 23, and a second extension segment 222 that is connected with the first extension segment 221 and is in a turned position with respect to the first extension segment 221. For example, in the first embodiment, the first extension segment 221 extends in a third direction (a positive y-direction) relative to the grounding portion 23, and the second extension segment 222 extends in a first direction (a positive x-direction) relative to the first extension segment 221. However, the present disclosure is not limited thereto. In this way, in the present disclosure, a second cavity T2 that is in the shape of the letter "C" is formed by the fourth radiation portion 22 and the grounding portion 23. However, the present disclosure is not limited thereto. In addition, it should be noted that, the first direction, the second direction and the third direction are different from each other in the present disclosure. That is to say, the first direction is opposite to the second direction, the first direction is perpendicular to the third direction, and the second direction is perpendicular to the third direction.

Further, a junction between the feeding end 31 of the feeding element 3 and the feeding portion 13 is defined as a feeding point F. A first predetermined distance L1 is defined in a first direction (a positive x-direction) between an edge R1 of an open end of the first radiation portion 11 and the feeding point F, a second predetermined distance L2 is defined in the first direction (the positive x-direction) between an edge R2 of an open end of the third radiation portion 21 and the feeding point F, and the first predetermined distance L1 is less than the second predetermined distance L2. In other words, the first predetermined distance L1 and the second predetermined distance L2 are distances measured along the first direction (the positive x-direction) with the feeding point F being a reference point. In addition, a length of the third radiation portion 21 extending in the first direction with respect to the feeding point F is greater than a length of the first radiation portion 11 extending in the first direction with respect to the feeding point F.

A third predetermined distance L3 is defined in the first direction (the positive x-direction) between the feeding point F and an edge R3 of an open end of the fourth radiation portion 22, a fourth predetermined distance L4 is defined in the first direction (the positive x-direction) between the feeding point F and an edge R4 of an open end of the grounding portion 23, and the third predetermined distance L3 is less than the fourth predetermined distance L4. In other words, the third predetermined distance L3 and the fourth predetermined distance L4 are distances measured along the first direction (the positive x-direction) with the feeding point F being a reference point. In addition, a length of the grounding portion 23 extending in the first direction with respect to the feeding point F is greater than a length of the fourth radiation portion 22 extending in the first direction with respect to the feeding point F. However, it should be noted that the third predetermined distance L3 can be greater than the fourth predetermined distance L4 in other embodiments, and the present disclosure is not limited thereto.

Further referring to FIG. 1, in the present disclosure, the third radiation portion 21 and the first radiation portion 11 are separate from each other and coupled to each other, the third radiation portion 21 and the second radiation portion 12 are separate from each other and coupled to each other, and the fourth radiation portion 22 and the first radiation portion 11 are separate from each other and coupled to each other. Under this configuration, the antenna structure U is capable of generating a corresponding operating frequency band. For example, in the present disclosure, the third radiation portion 21 and the first radiation portion 11 are separate from each other and coupled to each other, and the third radiation portion 21 and the second radiation portion 12 are separate from each other and coupled to each other, so as to generate an operating frequency band with a frequency range between 617 MHz and 960 MHz. In addition, the first radiation portion 11 can generate an operating frequency band with a frequency range between 1400 MHz and 2300 MHz, and the second radiation portion 12 can generate an operating frequency band with a frequency range between 2300 MHz and 2700 MHz. The fourth radiation portion 22 and the first radiation portion 11 are separate from each other and coupled to each other, so as to generate am operating frequency band with a frequency range between 3300 MHz and 3800 MHz. Moreover, the first radiation portion 11 can generate an operating frequency band with a frequency range between 4200 MHz and 4800 MHz by frequency multiplication. When the third radiation portion 21 and the first radiation portion 11 are separate from each other and coupled to each other, and the third radiation portion 21 and the second radiation portion 12 are separate from each other and coupled to each other, an operating frequency with a frequency range between 5100 MHz and 5850 MHz can be generated by frequency multiplication. It should be noted that the present disclosure is not limited to the frequency ranges of the above-mentioned operating frequency bands. In addition, it is worth mentioning that, it is by utilizing the technical feature of the first predetermined distance L1 being less than the second predetermined distance L2 that the antenna structure U is capable of generating an operating frequency band with a frequency range between 617 MHz and 698 MHz in the present disclosure.

Second Embodiment

Figure 2:
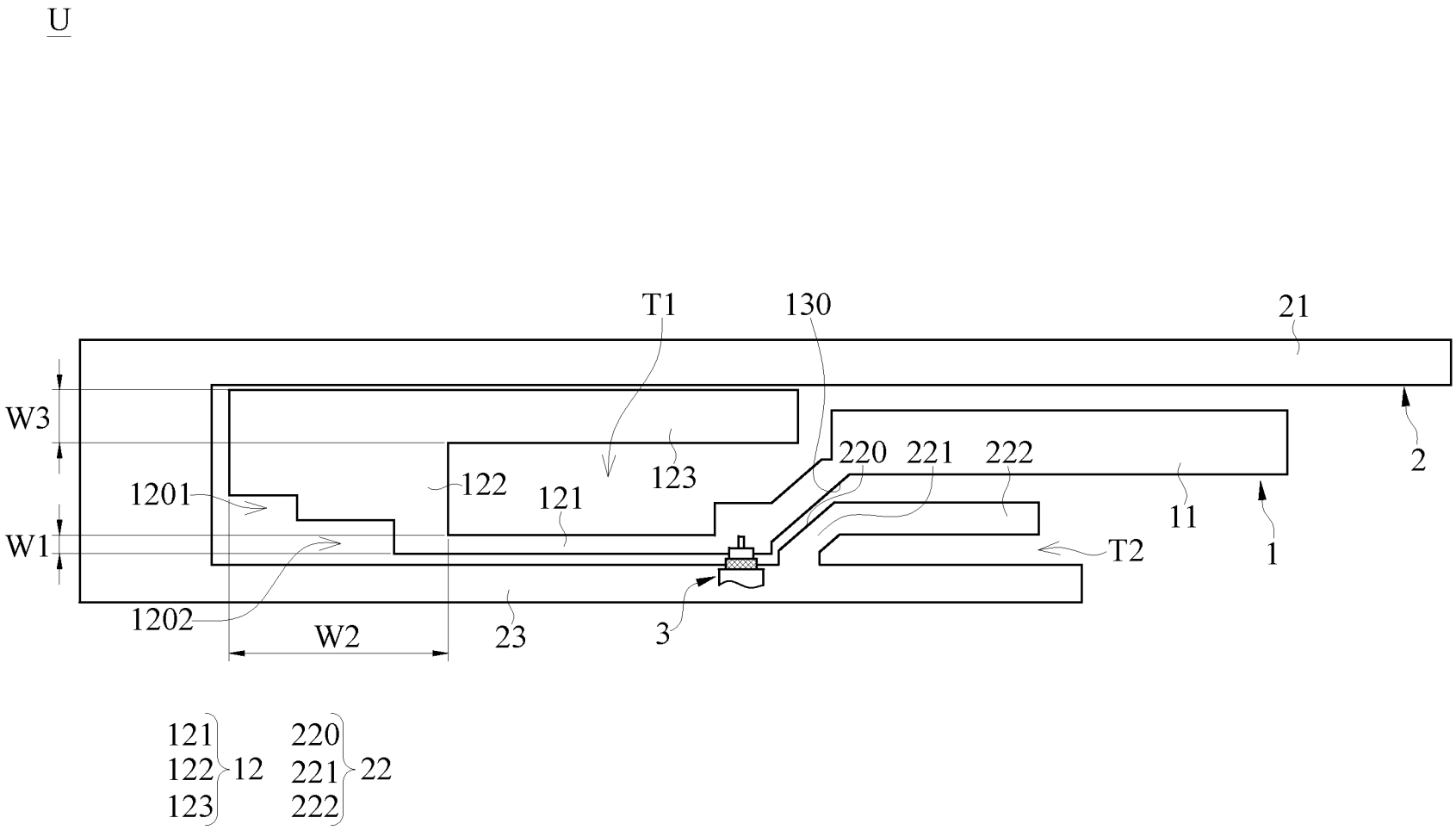
FIG. 2 is a top schematic view of an antenna structure according to a second embodiment of the present disclosure.

Reference is made to FIG. 2, in which a top schematic view of an antenna structure according to a second embodiment of the present disclosure is shown. As can be seen by comparing FIG. 2 with FIG. 1, the main difference between the second embodiment and the first embodiment is that, by adjusting a structure of the first radiation element 1 of the antenna structure U provided in the second embodiment, the overall performance of the antenna structure U can be further enhanced. In addition, it should be noted that, other structural features as shown in the second embodiment are similar to the descriptions of the previous embodiment and will not be repeated herein. Moreover, for the clarity of the figures, the substrate S, the grounding element 4 and the bridging element 5 are omitted.

Following the above, in the second embodiment, the first radiator 121 has a first maximum predetermined width W1, the second radiator 122 has a second maximum predetermined width W2, and the third radiator 123 has a third maximum predetermined width W3. The second maximum predetermined width W2 is greater than the third maximum predetermined width W3, and the third maximum predetermined width W3 is greater than the first maximum predetermined width W1. Preferably, in the second embodiment, the second radiation element 2 further includes a first recess 1201 that is formed on the second radiator 122, and a second recess 1202 that is formed on the second radiator 122 and adjacent to the first recess 1201. A recess having a stepped shape is formed by the first recess 1201 and the second recess 1202 relative to the second radiator 122. Furthermore, an opening direction of the first recess 1201 and the second recess 1202 extends in a second direction (a negative x-direction) and a fourth direction (a negative y-direction). That is to say, the first recess 1201 and the second recess 1202 are disposed adjacent to the grounding portion 23. In this way, in comparison with the first embodiment in which the first maximum predetermined width W1 of the first radiator 121, the second maximum predetermined width W2 of the second radiator 122, and the third maximum predetermined width W3 of the third radiator 123 are all the same, the antenna structure U provided in the second embodiment is capable of increasing a bandwidth of an operating frequency band with a frequency range between 4600 MHz and 5400 MHz as generated by the antenna structure U, and enhancing the effectiveness of radiation.

The feeding portion 13 has an oblique side 130, and the first extension segment 221 of the fourth radiation portion 22 has an oblique side 220. The oblique side 130 of the feeding portion 13 and the oblique side 220 of the first extension segment 221 are opposite to each other and parallel with each other. It should be noted that, in the second embodiment, an extension direction of the feeding portion 13 relative to the feeding point F and an extension direction of the first extension segment 221 relative to the grounding portion 23 can be a direction between the first direction (the positive x-direction) and the third direction (the positive y-direction). Moreover, as shown in the figure, the extension direction of the first extension segment 221 extends diagonally upward. Through the configuration of the oblique side 130 of the feeding portion 13 and the oblique side 220 of the fourth radiation portion 22, a center frequency of the operating frequency band with a frequency range between 1400 MHz and 2300 MHz and a bandwidth of the operating frequency band with a frequency range between 3300 MHz and 3800 MHz can be adjusted.

In the second embodiment, preferably, the fourth radiation portion 22 can further include a third extension segment 223. The third extension segment 223 is connected with the second extension segment 222 and is protrudingly arranged relative to the second extension segment 222, and extends in a third direction (a positive y-direction) relative to the second extension segment 222. In this way, the third extension segment 223 can be used to adjust a coupling coefficient of the fourth radiation portion 22 and the first radiation portion 11.

Third Embodiment

Figure 3:
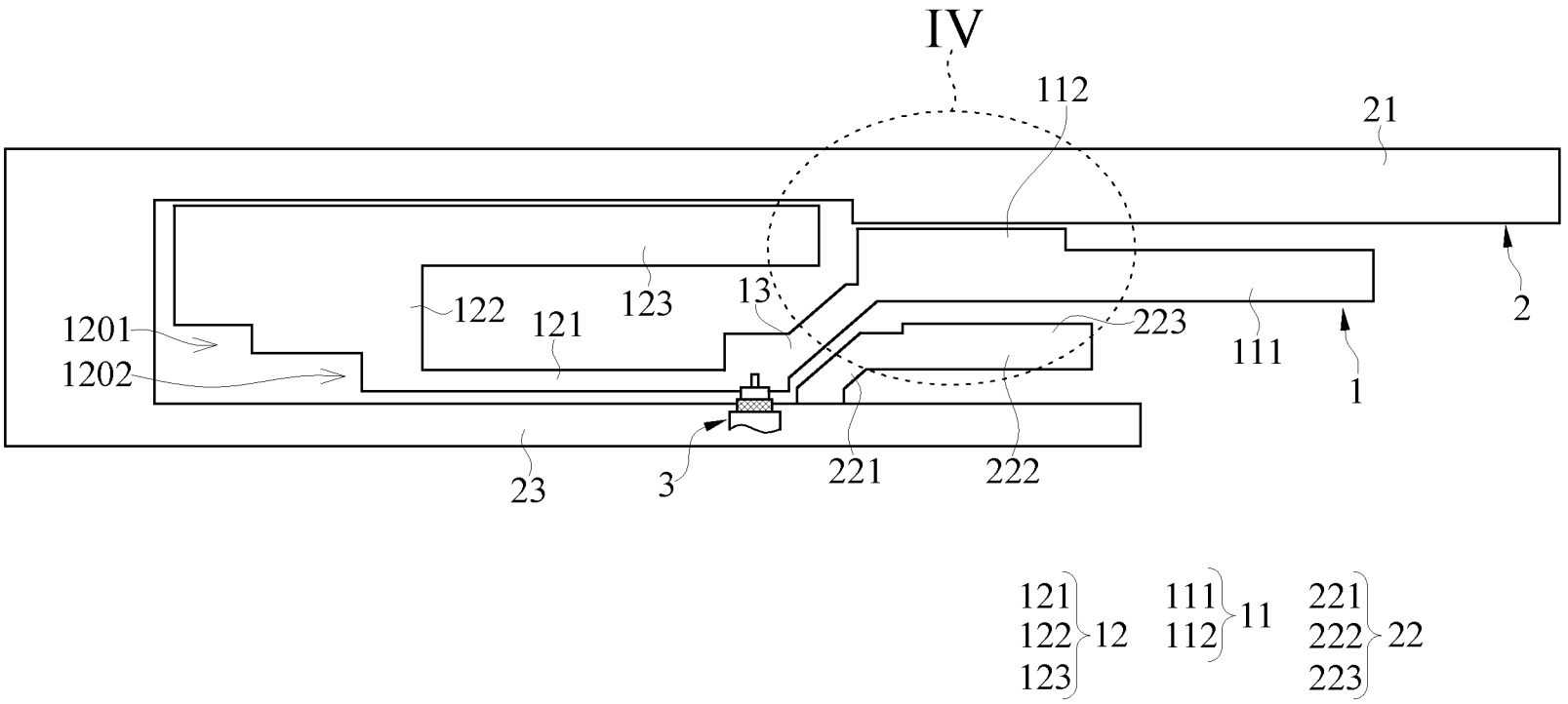
FIG. 3 is a top schematic view of an antenna structure according to a third embodiment of the present disclosure.
Figure 4:
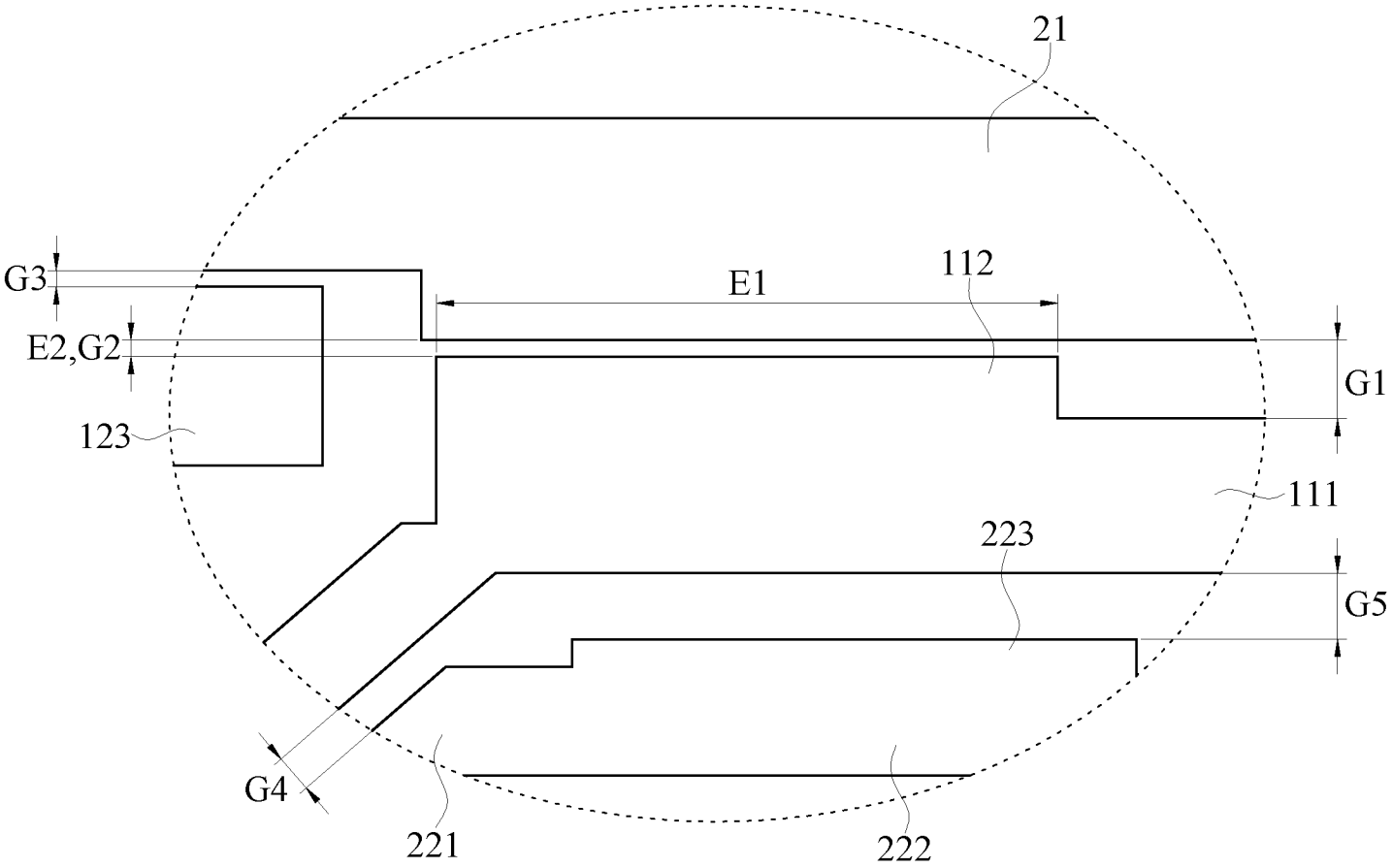
FIG. 4 shows an enlarged view of part IV of FIG. 3.

References are made to FIG. 3 and FIG. 4, in which FIG. 3 is a top schematic view of an antenna structure according to a third embodiment of the present disclosure, and FIG. 4 is an enlarged view of part IV of FIG. 3. As can be seen by comparing FIG. 3 with FIG. 2, the main difference between the third embodiment and the second embodiment is that, by adjusting a structure of the first radiation element 1 of the antenna structure U provided in the third embodiment, the overall performance of the antenna structure U can be further enhanced. In addition, it should be noted that, other structural features as shown in the third embodiment are similar to the descriptions of the previous embodiments and will not be repeated herein.

Following the above, in the third embodiment, the first radiation portion 11 includes a body 111, and a protruding part 112 that is electrically connected with the body 111 and protrudes in a direction toward the third radiation portion 21. The body 111 of the first radiation portion 11 extends in a first direction (a positive x-direction) relative to the feeding portion 13, and the protruding part 112 extends in a third direction (a positive y-direction) relative to the body 111. Further, in the third direction (the positive y-direction), a first predetermined gap G1 is defined between the body 111 and the third radiation portion 21, and a second predetermined gap G2 is defined between the protruding part 112 and the third radiation portion 21. The first predetermined gap G1 is greater than the second predetermined gap G2. For example, the second predetermined gap G2 can be less than 0.8 millimeters (mm) and greater than 0 millimeters. Preferably, the second predetermined gap G2 is between 0.1 millimeters and 0.8 millimeters. Moreover, an electrical length is defined between the feeding point F and the protruding part 112, and the electrical length is less than one fourth of a wavelength (λ/4) corresponding to a lowest operating frequency of the operating frequency band between 4200 MHz and 4800 MHz as generated by the first radiation portion 11. In this way, the protruding part 112 can be used to adjust a coupling coefficient of the first radiation portion 11 and the third radiation portion 21. For example, through the configuration of the protruding part 112, a center frequency of the operating frequency band with a frequency range between 4200 MHz and 4800 MHz as generated by the first radiation portion 11 can be adjusted.

Reference is further made to FIG. 4. For example, a third predetermined gap G3 is defined in the third direction (the positive y-direction) between the third radiator 123 and the third radiation portion 21, and the third predetermined gap G3 is less than 1 millimeter and greater than 0 millimeters. A fourth predetermined gap G4 is defined in the first direction (the positive x-direction) between the first extension segment 221 of the fourth radiation portion 22 and the feeding portion 13, and the fourth predetermined gap G4 is less than 2 millimeters and greater than 0 millimeters. A fifth predetermined gap G5 is defined in a third direction (a positive y-direction) between the first radiation portion 11 and the fourth radiation portion 22, and the fifth predetermined gap G5 is less than 3.5 millimeters and greater than 0 millimeters. However, it should be noted that the present disclosure is not limited to the abovementioned examples.

Figure 5:
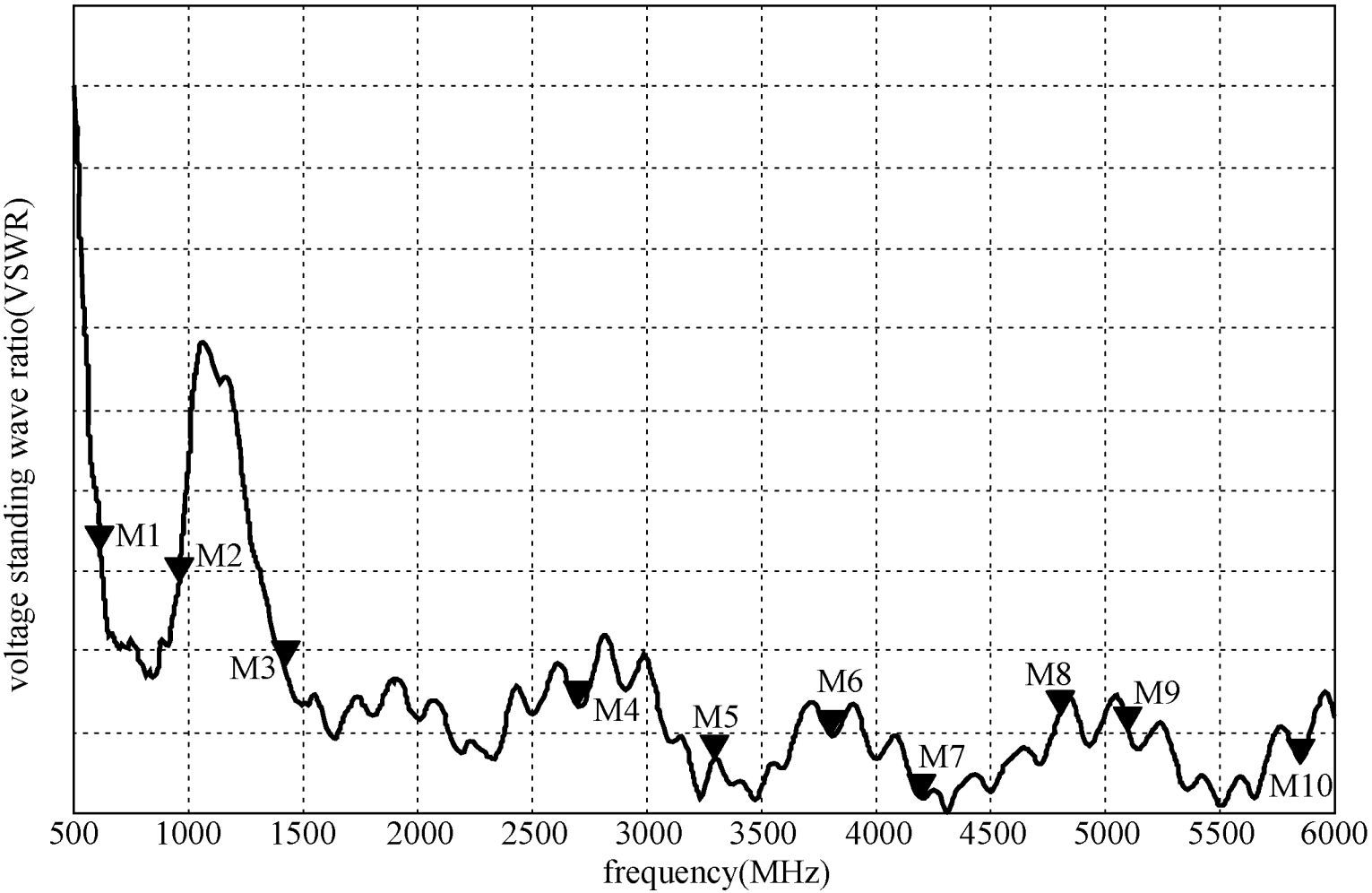
FIG. 5 is a curve diagram showing voltage standing wave ratio versus frequency for the antenna structure of FIG. 3.

References are made to FIG. 5 and the following Table 1, in which FIG. 5 is a curve diagram showing voltage standing wave ratio (VSWR) versus frequency for the antenna structure of FIG. 3.

TABLE 1

| Node | Frequency (MHz) | Voltage standing wave ratio |
|---|---|---|
| M1 | 617 | 4.2559 |
| M2 | 960 | 3.8637 |
| M3 | 1425 | 2.8361 |
| M4 | 2700 | 2.3413 |
| M5 | 3300 | 1.6616 |
| M6 | 3800 | 1.9655 |
| M7 | 4200 | 1.1852 |
| M8 | 4800 | 2.2295 |
| M9 | 5150 | 2.0165 |
| M10 | 5850 | 1.6350 |

Figure 6:
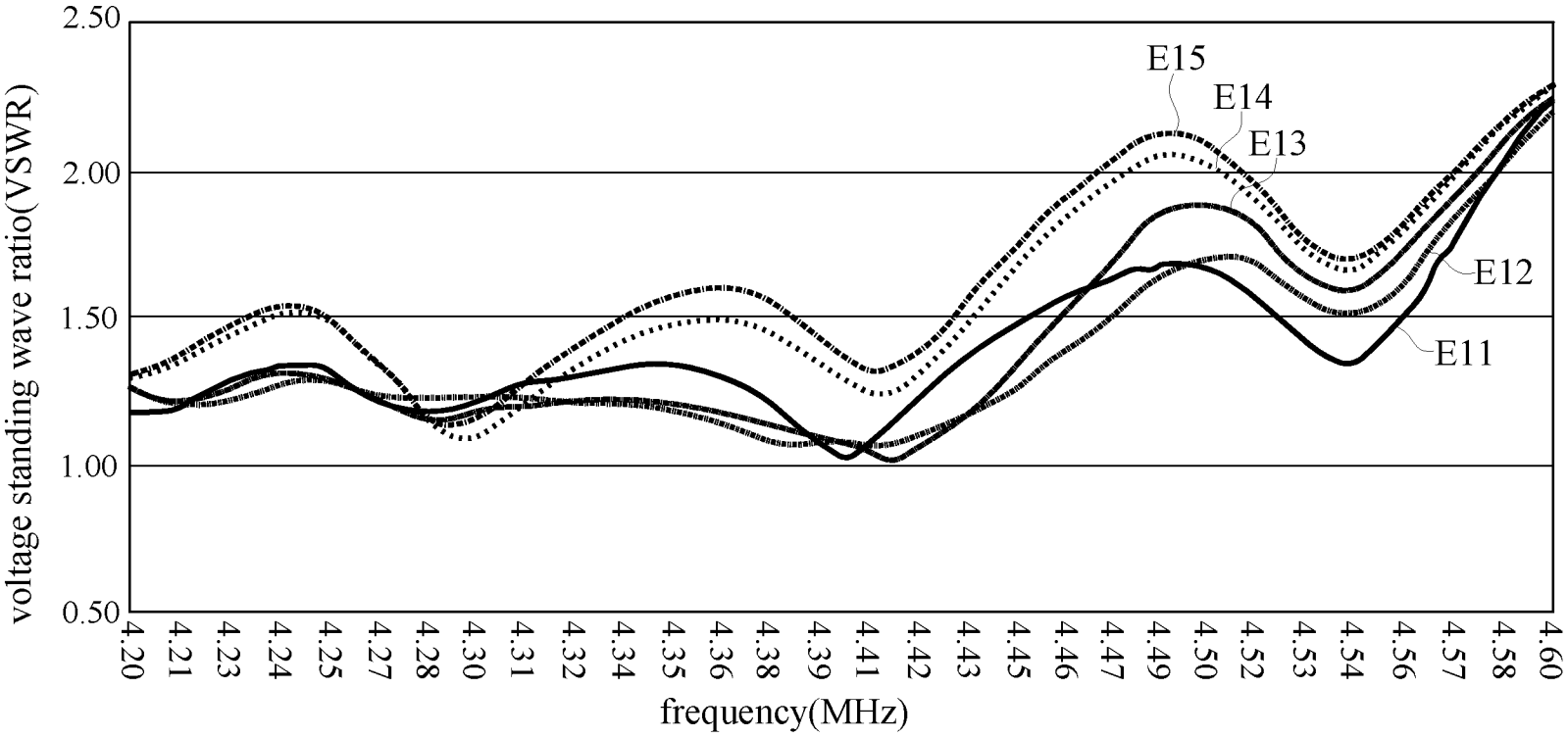
FIG. 6 is a curve diagram showing voltage standing wave ratio versus frequency as the antenna structure of FIG. 3 is adjusted.

References are further made to FIG. 3 and FIG. 4, which are to be read in conjunction with FIG. 6. FIG. 6 is a curve diagram showing voltage standing wave ratio versus frequency as the antenna structure of FIG. 3 is adjusted. A curved line E11 in FIG. 6 represents a curved line formed when a predetermined size E1 of the protruding part 112 of the antenna structure U in the embodiment of FIG. 3 in the first direction (the positive x-direction) is 11.5 millimeters. A curved line E12 in FIG. 6 represents a curved line formed when the predetermined size E1 of the protruding part 112 of the antenna structure U in the embodiment of FIG. 3 in the first direction (the positive x-direction) is 10.5 millimeters. A curved line E13 in FIG. 6 represents a curved line formed when the predetermined size E1 of the protruding part 112 of the antenna structure U in the embodiment of FIG. 3 in the first direction (the positive x-direction) is 8 millimeters. A curved line E14 in FIG. 6 represents a curved line formed when the predetermined size E1 of the protruding part 112 of the antenna structure U in the embodiment of FIG. 3 in the first direction (the positive x-direction) is 6 millimeters. A curved line E15 in FIG. 6 represents a curved line formed when the predetermined size E1 of the protruding part 112 of the antenna structure U in the embodiment of FIG. 3 in the first direction (the positive x-direction) is 4 millimeters. Under this configuration, the radiation effectiveness of the antenna structure U can be adjusted through adjusting the predetermined size E1 of the protruding part 112 in the first direction (the positive x-direction).

Figure 7:
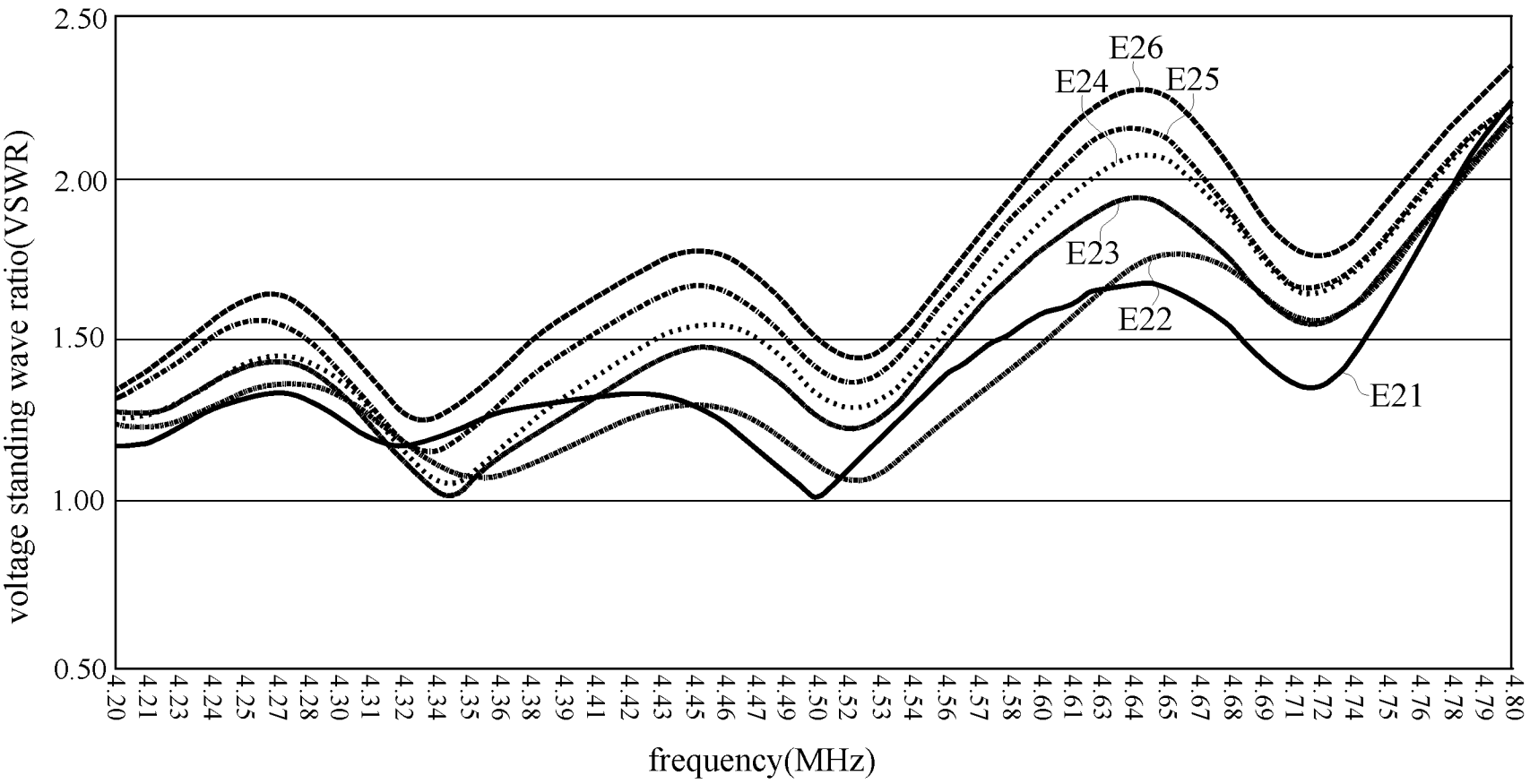
FIG. 7 is another curve diagram showing voltage standing wave ratio versus frequency as the antenna structure of FIG. 3 is adjusted.

References are further made to FIG. 3 and FIG. 4, which are to be read in conjunction with FIG. 7. FIG. 7 is another curve diagram showing voltage standing wave ratio versus frequency as the antenna structure of FIG. 3 is adjusted. A curved line E21 in FIG. 7 represents a curved line formed when a predetermined size E2 (i.e., the second predetermined gap G2) between the protruding part 112 and the first radiation portion 11 of the antenna structure U in the embodiment of FIG. 3 in the third direction (the positive y-direction) is 0.2 millimeters. A curved line E22 in FIG. 7 represents a curved line formed when the predetermined size E2 between the protruding part 112 and the first radiation portion 11 of the antenna structure U in the embodiment of FIG. 3 in the third direction (the positive y-direction) is 0.3 millimeters. A curved line E23 in FIG. 7 represents a curved line formed when the predetermined size E2 between the protruding part 112 and the first radiation portion 11 of the antenna structure U in the embodiment of FIG. 3 in the third direction (the positive y-direction) is 0.4 millimeters. A curved line E24 in FIG. 7 represents a curved line formed when the predetermined size E2 between the protruding part 112 and the first radiation portion 11 of the antenna structure U in the embodiment of FIG. 3 in the third direction (the positive y-direction) is 0.5 millimeters. A curved line E25 in FIG. 7 represents a curved line formed when the predetermined size E2 between the protruding part 112 and the first radiation portion 11 of the antenna structure U in the embodiment of FIG. 3 in the third direction (the positive y-direction) is 0.8 millimeters. A curved line E26 in FIG. 7 represents a curved line formed when the predetermined size E2 between the protruding part 112 and the first radiation portion 11 of the antenna structure U in the embodiment of FIG. 3 in the third direction (the positive y-direction) is 1.3 millimeters. Under this configuration, the radiation effectiveness of the antenna structure U can be adjusted through adjusting the predetermined size E2 between the protruding part 112 and the first radiation portion 11 in the third direction (the positive y-direction).

Fourth Embodiment

Figure 8:
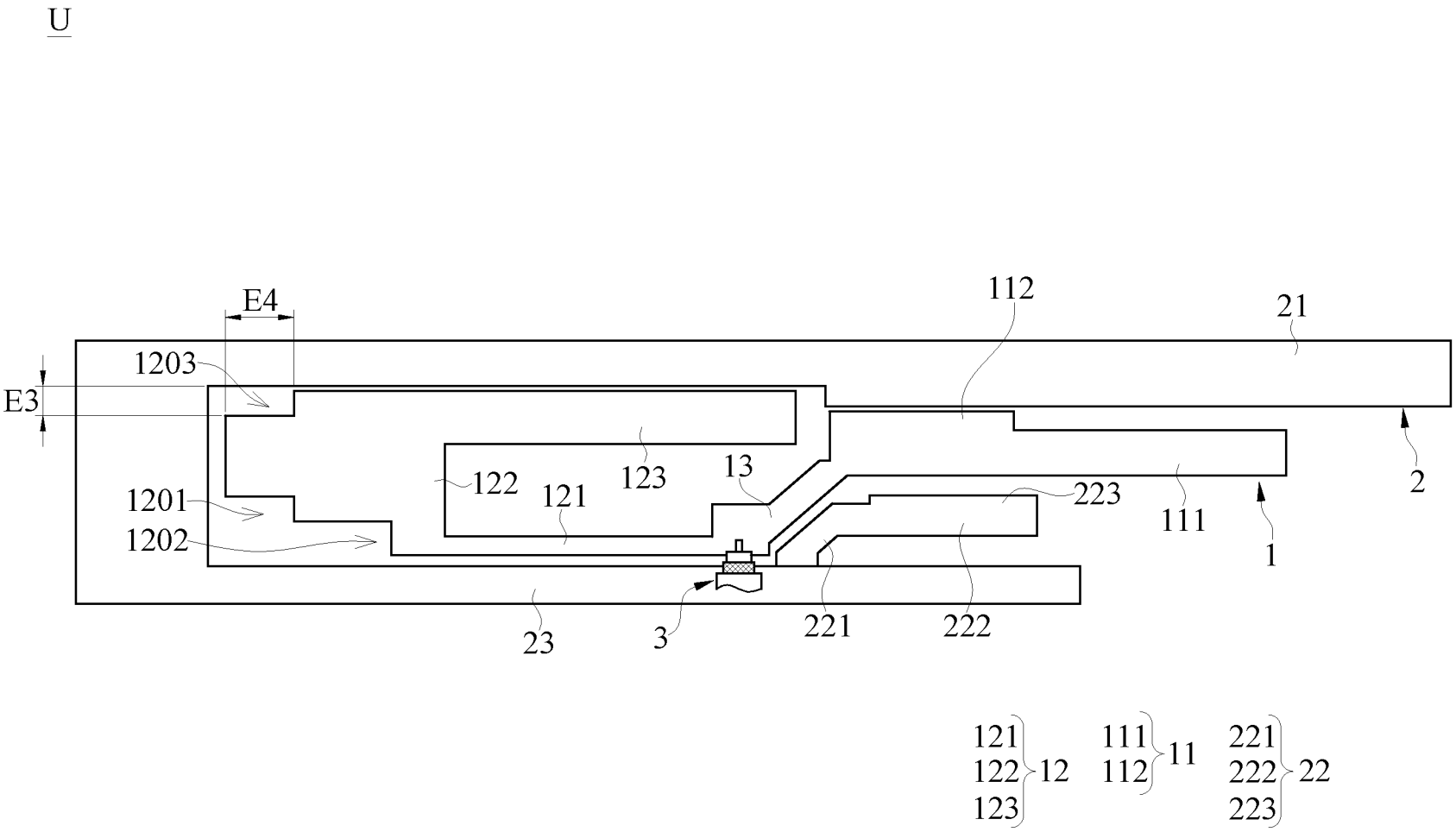
FIG. 8 is a top schematic view of an antenna structure according to a fourth embodiment of the present disclosure.
Figure 9:
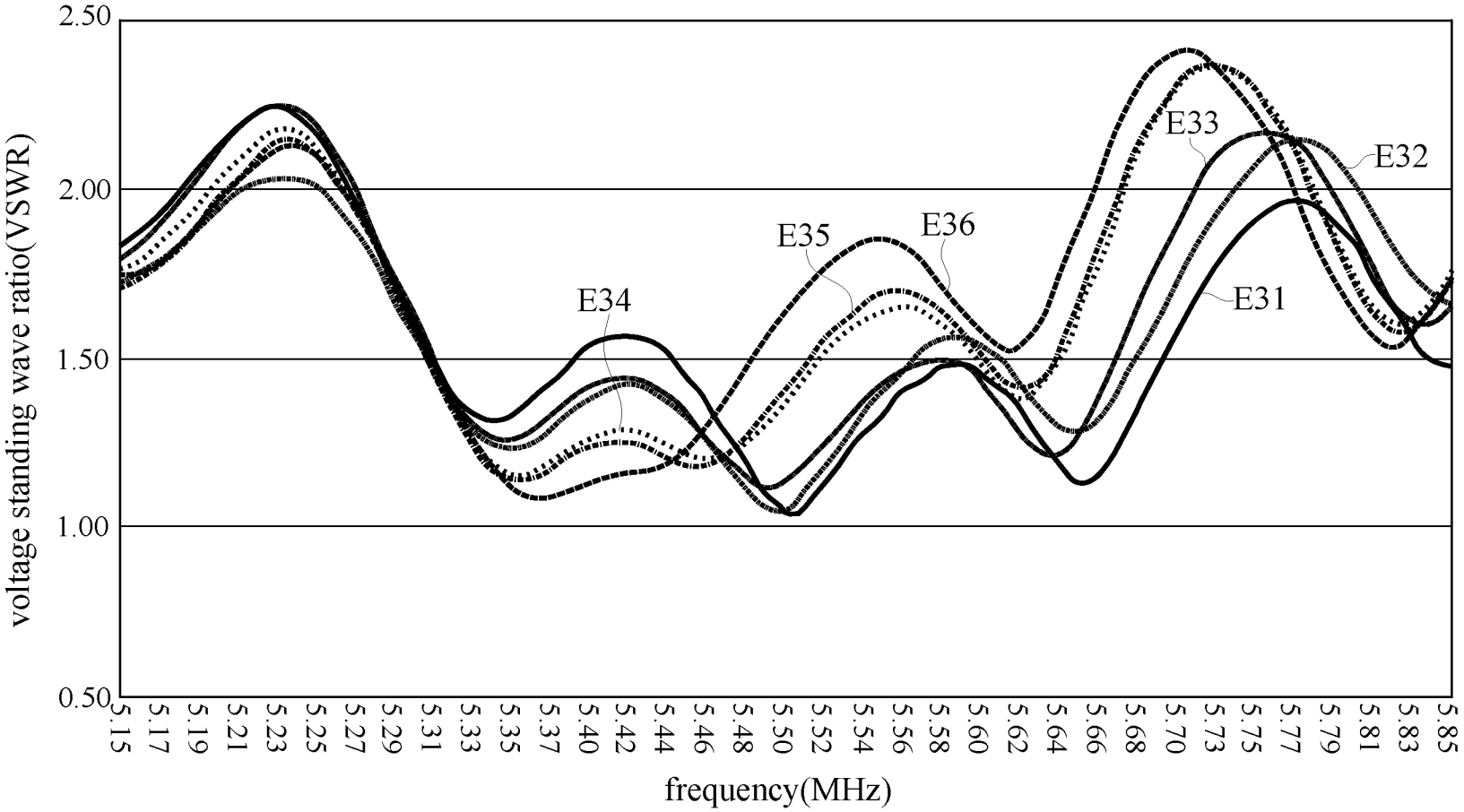
FIG. 9 is a curve diagram showing voltage standing wave ratio versus frequency as the antenna structure of FIG. 8 is adjusted.

References are made to FIG. 8 and FIG. 9, in which FIG. 8 is a top schematic view of an antenna structure according to a fourth embodiment of the present disclosure, and FIG. 9 is a curve diagram showing voltage standing wave ratio versus frequency as the antenna structure of FIG. 8 is adjusted. In the fourth embodiment, the second radiation portion 12 further includes a third recess 1203 that is formed on the second radiator 122. Furthermore, an opening direction of the third recess 1203 extends in a second direction (a negative x-direction) and a third direction (a positive y-direction). That is to say, the third recess 1203 is disposed adjacent to the third radiation portion 21.

Further, for example, the third recess 1203 has a predetermined size E4 in a first direction (a positive x-direction), and a predetermined size E3 in a third direction (a positive y-direction) between the third radiation portion 21 and a surface of the third recess 1203. The present disclosure is described by taking the predetermined size E4 of the third recess 1203 in the first direction (the positive x-direction) being 10 millimeters as an example. More specifically, a curved line E31 in FIG. 9 represents a curved line formed when the predetermined size E3 between the surface of the third recess 1203 and the third radiation portion 21 of the antenna structure U in the embodiment of FIG. 8 in the third direction (the positive y-direction) is 0.3 millimeters. A curved line E32 in FIG. 9 represents a curved line formed when the predetermined size E3 between the surface of the third recess 1203 and the third radiation portion 21 of the antenna structure U in the embodiment of FIG. 8 in the third direction (the positive y-direction) is 0.4 millimeters. A curved line E33 in FIG. 9 represents a curved line formed when the predetermined size E3 between the surface of the third recess 1203 and the third radiation portion 21 of the antenna structure U in the embodiment of FIG. 8 in the third direction (the positive y-direction) is 0.5 millimeters. A curved line E34 in FIG. 9 represents a curved line formed when the predetermined size E3 between the surface of the third recess 1203 and the third radiation portion 21 of the antenna structure U in the embodiment of FIG. 8 in the third direction (the positive y-direction) is 0.6 millimeters. A curved line E35 in FIG. 9 represents a curved line formed when the predetermined size E3 between the surface of the third recess 1203 and the third radiation portion 21 of the antenna structure U in the embodiment of FIG. 8 in the third direction (the positive y-direction) is 0.7 millimeters. A curved line E36 in FIG. 9 represents a curved line formed when the predetermined size E3 between the surface of the third recess 1203 and the third radiation portion 21 of the antenna structure U in the embodiment of FIG. 8 in the third direction (the positive y-direction) is 1 millimeter. Under this configuration, the radiation effectiveness of the antenna structure U can be adjusted through adjusting the predetermined size E4 of the third recess 1203 in the first direction (the positive x-direction) and/or the predetermined size E3 between the surface of the third recess 1203 and the third radiation portion 21 in the third direction (the positive y-direction).

Beneficial Effects of the Embodiments

One of the beneficial effects of the present disclosure is that, by virtue of "a first predetermined distance L1 being defined in a first direction (a positive x-direction) between an edge R1 of an open end of the first radiation portion 11 and the feeding point F, a second predetermined distance L2 being defined in the first direction (the positive x-direction) between an edge R2 of an open end of the third radiation portion 21 and the feeding point F, and the first predetermined distance L1 being less than the second predetermined distance L2", the antenna structure U of the present disclosure can generate the operating frequency band with a frequency range between 617 MHz and 698 MHz.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a first radiation element including a first radiation portion, a second radiation portion, and a feeding portion that is electrically connected between the first radiation portion and the second radiation portion;

a second radiation element including a third radiation portion, a fourth radiation portion, and a grounding portion that is electrically connected between the third radiation portion and the fourth radiation portion, wherein the third radiation portion and the first radiation portion are separate from each other and coupled to each other, the third radiation portion and the second radiation portion are separate from each other and coupled to each other, and the fourth radiation portion and the first radiation portion are separate from each other and coupled to each other; and a feeding element being electrically connected with the feeding portion and the grounding portion, with a junction between the feeding element and the feeding portion being defined as a feeding point;

wherein a first predetermined distance is defined in a first direction between an edge of an open end of the first radiation portion and the feeding point, a second predetermined distance is defined in the first direction between an edge of an open end of the third radiation portion and the feeding point, and the first predetermined distance is less than the second predetermined distance.

2. The antenna structure according to claim 1, wherein a surrounding area is formed by the third radiation portion, the grounding portion, and the fourth radiation portion, and the first radiation element is disposed in the surrounding area.

3. The antenna structure according to claim 1, wherein a third predetermined distance is defined in the first direction between the feeding point and an edge of an open end of the fourth radiation portion, a fourth predetermined distance is defined in the first direction between the feeding point and an edge of an open end of the grounding portion, and the third predetermined distance is less than the fourth predetermined distance.

4. The antenna structure according to claim 1, wherein the first radiation portion includes a body and a protruding part that is electrically connected with the body and protrudes in a direction toward the third radiation portion; wherein a first predetermined gap is defined between the body and the third radiation portion, a second predetermined gap is defined between the protruding part and the third radiation portion, and the first predetermined gap is greater than the second predetermined gap.

5. The antenna structure according to claim 4, wherein the second predetermined gap is less than 0.8 millimeters.

6. The antenna structure according to claim 4, wherein the first radiation portion generates an operating frequency band with a frequency range between 4200 MHz and 4800 MHz, an electrical length is defined between the feeding point and the protruding part, and the electrical length is less than one fourth of a wavelength corresponding to a lowest operating frequency of the operating frequency band between 4200 MHz and 4800 MHz as generated by the first radiation portion.

7. The antenna structure according to claim 1, wherein the second radiation portion includes a first radiator that is electrically connected with the feeding portion, a second radiator that is electrically connected with the first radiator and is in a turned position with respect to the first radiator, and a third radiator that is electrically connected with the second radiator and is in a turned position with respect to the second radiator, wherein the first radiator has a first maximum predetermined width, the second radiator has a second maximum predetermined width, the third radiator has a third maximum predetermined width, the second maximum predetermined width is greater than the third maximum predetermined width, and the third maximum predetermined width is greater than the first maximum predetermined width.

8. The antenna structure according to claim 7, wherein the first radiation portion extends in the first direction, the first radiator of the second radiation portion extends in a second direction, the second radiator of the second radiation portion extends in a third direction, the third radiator of the second radiation portion extends in the first direction, the fourth radiation portion extends in the first direction, and the first direction, the second direction and the third direction are different from each other.

9. The antenna structure according to claim 8, wherein a third predetermined gap is defined between the third radiator and the third radiation portion, and the third predetermined gap is less than 1 millimeter.

10. The antenna structure according to claim 1, wherein a fourth predetermined gap is defined in the first direction between the fourth radiation portion and the feeding portion, and the fourth predetermined gap is less than 2 millimeters.

11. The antenna structure according to claim 1, wherein a fifth predetermined gap is defined in a third direction between the first radiation portion and the fourth radiation portion, and the fifth predetermined gap is less than 3.5 millimeters.

12. The antenna structure according to claim 1, wherein the third radiation portion and the first radiation portion are separate from each other and coupled to each other, and the third radiation portion and the second radiation portion are separate from each other and coupled to each other, so as to generate an operating frequency band with a frequency range between 617 MHz and 960 MHz and an operating frequency band with a frequency range between 5100 MHz and 5850 MHz.

13. The antenna structure according to claim 1, wherein the first radiation portion generates an operating frequency band with a frequency range between 1400 MHz and 2300 MHz and an operating frequency band with a frequency range between 4200 MHz and 4800 MHz.

14. The antenna structure according to claim 1, wherein the second radiation portion generates an operating frequency band with a frequency range between 2300 MHz and 2700 MHz.

15. The antenna structure according to claim 1, wherein the fourth radiation portion and the first radiation portion are separate from each other and coupled to each other, so as to generate an operating frequency band with a frequency range between 3300 MHz and 3800 MHz.

* * * * *